US008672769B2

(12) United States Patent
Kroon et al.

(10) Patent No.: US 8,672,769 B2
(45) Date of Patent: Mar. 18, 2014

(54) SUPPORTING SYSTEM FOR A MAST

(75) Inventors: Albert Louisito Phillipus Kroon, Neede (NL); Jan Hendrik Wessel Hartemink, Lichtenvoorde (NL)

(73) Assignee: Cobra Beheer B.V., Neede (NL)

( * ) Notice: Subject to any disclaimer, the term of this patent is extended or adjusted under 35 U.S.C. 154(b) by 208 days.

(21) Appl. No.: 13/218,775

(22) Filed: Aug. 26, 2011

(65) Prior Publication Data

US 2012/0052960 A1 Mar. 1, 2012

(30) Foreign Application Priority Data

Aug. 26, 2010 (NL) ..... 2005272

(51) Int. Cl.
*A63G 27/00* (2006.01)
*A63G 1/24* (2006.01)

(52) U.S. Cl.
USPC ..... 472/3; 472/29; 472/33

(58) Field of Classification Search
USPC ..... 472/3, 27, 28, 29, 32, 33, 43
See application file for complete search history.

(56) References Cited

U.S. PATENT DOCUMENTS 3,885,503 A * 5/1975 Barber ..... 104/76
3,905,596 A * 9/1975 Barber ..... 472/3
4,903,959 A * 2/1990 Barber ..... 472/3
4,988,089 A 1/1991 Knijpstra
5,046,719 A * 9/1991 Comstock et al. ..... 472/49
5,676,601 A * 10/1997 Saunders ..... 472/29
5,957,778 A 9/1999 Larson
6,969,323 B1 11/2005 Von Bose et al.

OTHER PUBLICATIONS

Dutch Search Report, dated Apr. 11, 2011, from corresponding Dutch application.

* cited by examiner

*Primary Examiner* — Kien Nguyen
(74) *Attorney, Agent, or Firm* — Young & Thompson

(57) ABSTRACT

A supporting system for a mast, for example for a swing carousel, includes stabilizing vehicles which each include a chassis, sets of wheels for moving the stabilizing vehicle, coupling elements near one end of the chassis, and at least one stabilizing arm which is displaceable between an inoperative position in which the stabilizing arm is swung in and a swung-out position in which the stabilizing arm extends outwards with respect to the chassis. At their free ends, the stabilizing arms each have a support for stabilizing the stabilizing vehicle on the ground in the swung-out position of the stabilizing arm. A base is provided for the mast, which base includes complementary coupling elements situated opposite one another, one complementary coupling element of which is coupled to the coupling element of a stabilizing vehicle and the other complementary coupling element of which is coupled to the coupling element of another stabilizing vehicle.

22 Claims, 3 Drawing Sheets

SUPPORTING SYSTEM FOR A MAST

The invention relates to a support for masts such as those which are used for various purposes, in particular, but not exclusively, for amusement devices. Such amusement devices are often adapted to be mobile. This makes it possible to temporarily install the attraction at, for example, fairgrounds and also to transfer it in a relatively simple manner between different locations. Amusement devices such as swing carousels or other attractions which offer the public an opportunity to experience spectacular movements are relatively expensive, which means that the attraction has to be able to operate for a relatively long period of time in order for it to be successful. In order to achieve this, it is a prime requirement for the amusement device to be mobile.

It is already known to place attractions on a trailer. Reference is made to the tower disclosed in U.S. Pat. No. 5,957,778 which is accommodated on a trailer. The tower is configured to be telescopic and is extended to its full height after the retracted parts have been erected. The trailer is provided with supports by means of which it is placed in a stable position on the ground. Up to a certain height and load of the tower, such stabilization is sufficient. However, with relatively great heights, for example in the order of magnitude of 60-80 m, the associated loads cannot be absorbed sufficiently well by such a support using a single trailer.

In those cases, special support structures which are not, however, mobile have to be constructed at the respective location. This results in the loss of a significant advantage: erecting and dismantling the support structure and mast every time is time-consuming and costly, thus greatly reducing the operating efficiency of the device and rendering operation of the device uneconomical.

It is therefore an object of the invention to provide an amusement device of the abovementioned type which can be operated efficiently and which is suitable for much greater heights and loads than the traditional amusement devices. This object is achieved by means of a supporting system for a mast, for example for a swing carousel, comprising stabilizing vehicles which each comprise a chassis, sets of wheels for moving the vehicle, coupling means near the rear end, and at least one stabilizing arm which is displaceable between an inoperative position in which the stabilizing arm is swung in and a swung-out position in which the stabilizing arm extends outwards with respect to the chassis, which stabilizing arms each have a support at their free ends for stabilizing the stabilizing vehicle on the ground in the swung-out position of the stabilizing arm, as well as a base for the mast, which base cooperates with the stabilizing vehicles and wherein, in the coupled position of said stabilizing vehicles, the chassis of the one stabilizing vehicle is in line with the chassis of the other stabilizing vehicle.

With the supporting system according to the invention, several vehicles can be coupled to one another in order to produce a base having a relatively large width and length. The expression large width and length is understood to mean that these are large compared to the dimensions of the vehicles. The length of the base is, for example, equal to its width, and both are approximately equal to or greater than the longitudinal dimension of a vehicle. With conventional embodiments of a base, the width is often smaller than the length of the vehicle, due to the limited dimensions of the swing-out supports.

Due to the fact that the stabilizing vehicles are placed against one another and coupled to one another end to end, a central area can be formed from which the various stabilizing arms extend outward, which results in a very stable support of the mast in all directions. In this context, each stabilizing vehicle preferably has two stabilizing arms which can be swung out on either side of the chassis. However, it is also possible to provide a single stabilizing arm for each stabilizing vehicle. These are then preferably swung out on opposite sides of the coupled stabilizing vehicles.

The chassis may have a central beam from which the sets of wheels are suspended, as well as in each case one stabilizing arm on either side of the central beam, which central beam and stabilizing arms determine the nominal contour of the stabilizing vehicle in the swung-in position. The vehicle thus has a contour which makes it possible to use it on the road without requiring special features. The stabilizing arms are preferably suspended near the end of the central beam where the coupling means is situated. However, an embodiment is also conceivable in which the stabilizing arms are suspended near the attachment end of the chassis. Furthermore, a further support may be provided at a distance from the end of the central beam provided with the coupling means for stabilizing the stabilizing vehicle on the ground.

Preferably, the stabilizing arms decrease in height, calculated from the hinge suspension of the stabilizing arm(s). The stabilizing arms thus have the greatest flexural stiffness and flexural strength at the location of the mast, at the location where the moment of flexure is greatest. In this context, it is also advantageous to configure the central beam and/or the stabilizing arms as a box section. The pivot arms can each be suspended from the chassis via a pivoting suspension having a substantially vertical axis of rotation. At the front end of the chassis, an attachment means may be provided by means of which the stabilizing vehicle can be coupled to a tractor unit. The coupling means are preferably situated at the rear end of the stabilizing vehicle. The central beam may also decrease in height, similarly to the decrease in height of the stabilizing arms. According to a first possibility, the base comprises complementary coupling means situated opposite one another, one complementary coupling means of which is coupled to the coupling means of a stabilizing vehicle and the other complementary coupling means of which is coupled to the coupling means of another stabilizing vehicle. The base then transmits forces and moments of flexure between the stabilizing vehicles.

As has already been mentioned, the mast is positioned on a base which can be stabilized by the stabilizing vehicles and the associated stabilizing arms. Said base may be configured in different ways, for example in the form of a steel box structure which is provided with complementary couplings. In view of the mobile character of the stabilizing vehicles, the base may be configured as a mast vehicle comprising a chassis as well as parts fitted to the chassis of at least a part of the mast, which mast vehicle is provided with complementary coupling means on opposite sides. Like the stabilizing vehicles, the mast vehicle can be transported between various locations in a simple manner, for example by means of its own drive or by means of a tractor unit. Coupling to the stabilizing vehicles is preferably effected by means of complementary coupling means which are situated on both longitudinal sides of the mast vehicle.

The stabilizing vehicles may be positioned in line with one another. In this case, the stabilizing vehicles may be coupled to the mast vehicle on either side thereof at a substantially right angle. The mast or the lowest parts thereof are then preferably situated on that part of the mast vehicle where the complementary coupling means are located, so that the mast is arranged directly between the coupled stabilizing vehicles. This means that the stabilizing arms of the stabilizing vehicles are also situated around the mast in an evenly distributed manner, as a result of which the stability is the same in all directions.

According to another possibility, the coupling means of the stabilizing vehicles are coupled directly to one another. This results in a very stiff connection between the stabilizing vehicles. This possibility means that the stabilizing vehicles are connected to one another without the use of the base. However, it is also possible to couple the stabilizing vehicles directly to one another at a relatively low level via a tensile connection, and to couple them indirectly to one another at a relatively high level via a pressure-absorbing connecting piece, such as the base and/or the bottom part of the mast. This tensile connection may be pivotable about a pivot axis which extends transversely to and substantially horizontally between the stabilizing vehicles. In combination with the pressure-absorbing connecting piece, a stiff, statically defined structure is achieved.

As mentioned above, a support system configured in this way is completely mobile. To this end, the vehicles may comprise dedicated drives and control systems. According to a preferred embodiment, the stabilizing vehicles and/or the mast vehicle are configured as a trailer which can be displaced by a tractor unit.

The invention also relates to a stabilizing vehicle for use with the supporting system as described above, comprising a chassis with sets of wheels for moving the vehicle, which chassis, near one end, has coupling means which can be coupled to a base of a mast to be stabilized so as to be flexurally stiff and exhibit shear rigidity.

The invention furthermore relates to a mast vehicle for use with the supporting system as described above, comprising a chassis which has coupling means on either side, each of which can be coupled to a respective stabilizing vehicle.

The invention also relates to an amusement device, such as a swing carousel, comprising a supporting system as described above, a mast and accommodation means for at least one person, which accommodation means are suspended from the mast.

The invention will now be described with reference to an exemplary embodiment which is illustrated in the figures, in which.

Figure 1:
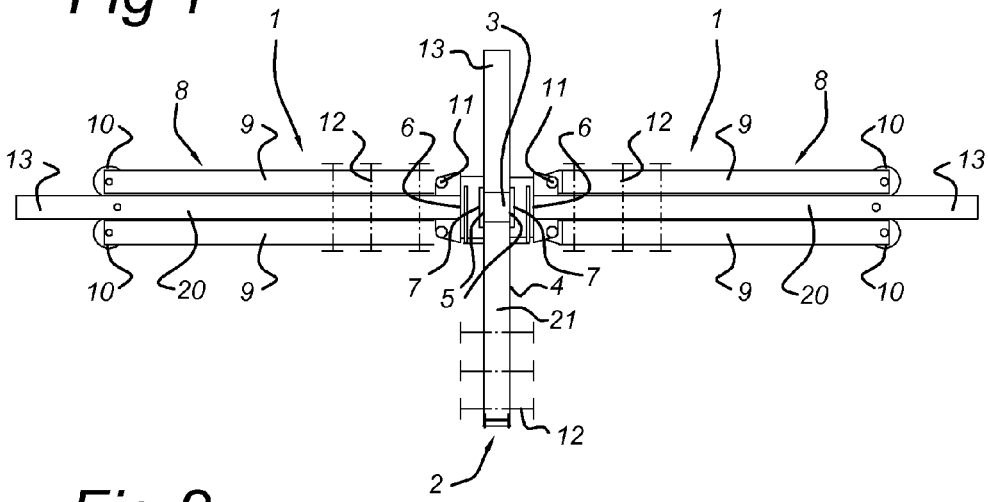
FIG. 1 shows a first embodiment of the supporting system in plan view with swung-in stabilizing arms.
Figure 2:
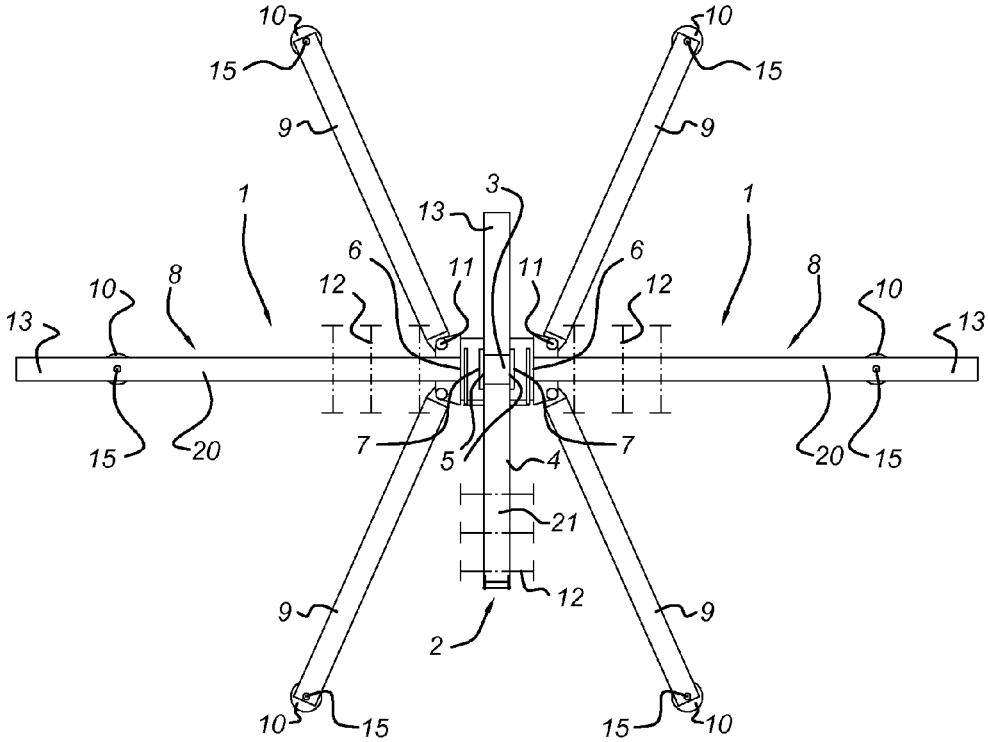
FIG. 2 shows a plan view of the embodiment from FIG. 1 with swung-out stabilizing arms.
Figure 3:
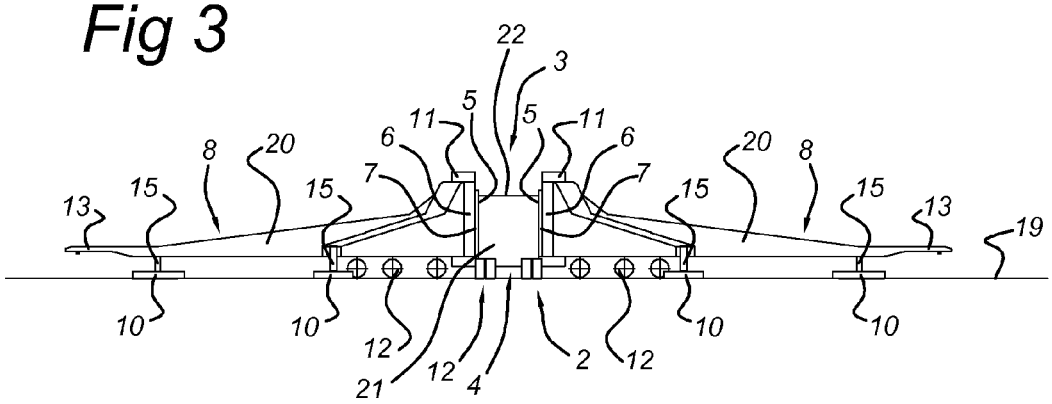
FIG. 3 shows a side view of the embodiment from FIG. 2.

FIGS. 1, 2 and 3 show an embodiment of the supporting system according to the invention which is composed of two stabilizing vehicles 1 and a mast vehicle 2. A mast 3 is erected on this mast vehicle 2 and supported by the support part 22. Complementary coupling means 5 are provided near the rear of the mast vehicle 2, on both longitudinal sides 4 thereof. At their rear end 6, the stabilizing vehicles 1 each have coupling means 7 which are securely coupled to the complementary coupling means 5 of the mast vehicle. The stabilizing vehicles 1 and the mast vehicle 2 each have sets of wheels 12; the front end thereof has an attachment means 13 to which a tractor unit (not shown) can be coupled for the purpose of displacing the vehicles. Instead of an attachment means, a set of wheels can be fitted to the front end, in which case the vehicles are configured as trailers.

The stabilizing vehicles 2 each have a chassis 8 which comprises a central beam 20 and the attachment means 13. Stabilizing arms 9 are provided on both sides of the central beam 20. At the free end of the stabilizing arms, support plates 10 are provided which can rest on the ground 19 by means of, for example, screw spindles 15 or hydraulic piston/cylinder devices. The stabilizing arms are pivotably suspended near the rear end 6 of the chassis 8 of the stabilizing vehicles by means of pivots having a vertical axis 11. As is illustrated in FIGS. 2 and 3, the stabilizing arms can be rotated through an angle of approximately 60 degrees with respect to the central beams 20. This results in an evenly distributed pattern of stabilizing arms and central beams, which are each supported on the ground by means of a base plate 10. This ensures a stable support of the mast 3. However, it is also possible to use fewer stabilizing arms, for example two in total. The stabilizing arms may, for example, also be swung out at an angle of approximately 45 degrees or 90 degrees.

Figure 4:
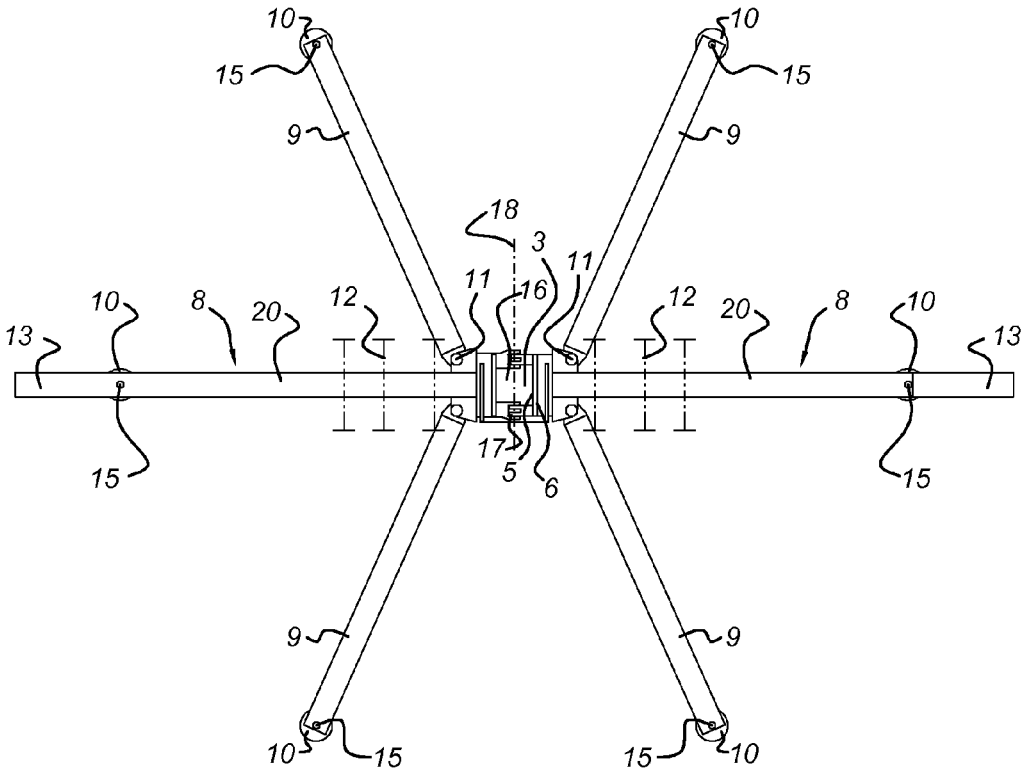
FIG. 4 shows a second embodiment of the supporting system in plan view.

On the whole, the variant illustrated in FIG. 4 corresponds to those illustrated in FIGS. 1-3, except that no mast vehicle 2 is used. The mast 3 is in this case supported by the base 16. This base 16 is provided with the complementary coupling means 5 which are securely connected to the coupling means 6 on the stabilizing vehicles 1. The mast 3 is arranged on the base 16.

Figure 5:
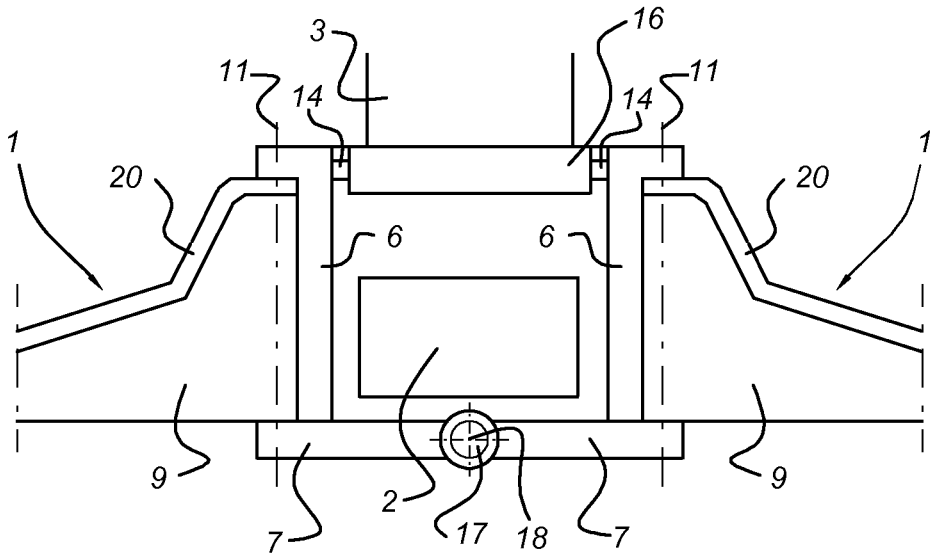
FIG. 5 shows a partial side view of a third embodiment.

The view from FIG. 5 shows that, according to a variant, the stabilizing vehicles 1 can be coupled to one another directly. The coupling means 7 are configured as forks which are rotatably connected to one another via a hinge pin 17. Between the ends 6 of the stabilizing vehicles 1 which are turned towards one another, a base 16 which is configured as a pressure-exerting piece is attached by means of the couplings 14, to which pressure-exerting piece 16 the mast is fitted. Via the hinged connection 7, 17 and the pressure connection 14, 16, a flexurally stiff mutual connection of the stabilizing vehicles is ensured. The mast vehicle 2 may extend transversely across the hinged connection 7, 17 and optionally be coupled thereto. In this position, the mast can be erected from the mast vehicle in a relatively simple manner and can be placed on the base, for example with the aid of a mobile lifting crane, and also be accommodated on the mast vehicle again. However, the stability of the supporting system is supplied by the stability vehicles 1, in particular by the central beams 20 and the swung-out stabilizing arms 9 thereof. However, the mast can also be erected autonomously by means of a hydraulic piston/cylinder device which is fitted between the mast vehicle and the mast.

LIST OF REFERENCE NUMERALS

1. Stabilizing vehicle
2. Mast vehicle
3. Mast
4. Longitudinal side of mast vehicle
5. Complementary coupling means of mast vehicle
6. Rear end of stabilizing vehicle
7. Coupling means of stabilizing vehicle
8. Chassis of stabilizing vehicle
9. Stabilizing arm
10. Base plate
11. Pivot suspension axis of stabilizing arm
12. Sets of wheels
13. Attachment means
14. Coupling of pressure piece/base
15. Screw spindle
16. Pressure piece/base
17. Hinge pin
18. Pivot axis of hinge pin
19. Ground

20. Central beam of stabilizing vehicle chassis

21. Mast vehicle chassis

22. Support part of mast vehicle

The invention claimed is:

1. A supporting system for a mast (3), comprising:

plural stabilizing vehicles (1), each stabilizing vehicle comprising a chassis (8), sets of wheels (12) for moving the stabilizing vehicle, coupling means (7) near one end (6) of the chassis (8), and at least one stabilizing arm (9) displaceable between an inoperative position in which the stabilizing arm (9) is swung in and a swung-out position in which the stabilizing arm (9) extends outwards with respect to the chassis (8), wherein the stabilizing arm has a free end, and a support (10, 15) at the free end for stabilizing the stabilizing vehicle (1) on the ground (19) in the swung-out position of the stabilizing arm; and a mast base (2, 16), wherein the mast base (2, 16) cooperates with the stabilizing vehicles (1) and wherein, in a coupled position of said stabilizing vehicles (1), the chassis (8) of the one stabilizing vehicle (1) is in line with the chassis (8) of another stabilizing vehicle, and wherein the mast base (2, 16) comprises complementary coupling means (5) situated opposite one another, a first of said complementary coupling means (5) being coupled to the coupling means (7) of the one stabilizing vehicle (1) and a second of said complementary coupling means (5) being coupled to the coupling means (7) of the other stabilizing vehicle (1).

2. The supporting system according to claim 1, wherein the one stabilizing vehicle has two stabilizing arms (9) which can be swung out on either side of the chassis (8).

3. The supporting system according to claim 1, wherein the chassis (8) has a central beam (20) from which each said stabilizing arm (9) is pivotably suspended near the one end (6) of the chassis (8) where the coupling means (7) is situated.

4. The supporting system according to claim 3, wherein the support (10, 15) is provided at a distance from the end (6) of the central beam (20) provided with the coupling means (7) for stabilizing each said stabilizing vehicle (1) on the ground (19).

5. The supporting system according to claim 3, wherein one said stabilizing arm (9) is provided on either side of the central beam (20), which central beam and stabilizing arms determine the nominal contour of each said stabilizing vehicle (1) in the swung-in position.

6. The supporting system according to claim 1, wherein the central beam (20) and the stabilizing arms (9) decrease in height, calculated from a hinge suspension (11) of the stabilizing arm(s) (9).

7. The supporting system according to claim 1, wherein the central beam (20) and/or the stabilizing arms (9) are configured as a box section.

8. The supporting system according to claim 1, wherein the angle through which the stabilizing arms (9) can be swung out with respect to the chassis (8) is approximately at least 45 degrees.

9. The supporting system according to claim 1, wherein the stabilizing arms (9) are each suspended from the chassis (8) via a pivoting suspension (11) having a substantially vertical axis of rotation.

10. The supporting system according to claim 1, wherein the base comprises a chassis (21), a mast support part (22) fitted to the chassis (21), and complementary coupling means (5) on opposite sides of the chassis (21).

11. The supporting system according to claim 10, wherein the complementary coupling means (5) are situated on both longitudinal sides (4) of the chassis (21) and the stabilizing vehicles (1) are coupled to the chassis (21) on either side thereof at a substantially right angle.

12. The supporting system according to claim 10, wherein the complementary coupling means (5) of the chassis (21) can respectively be coupled to the coupling means (7) of said one stabilizing vehicle (1) and said other stabilizing vehicle (1).

13. The supporting system according to claim 1, wherein the coupling means (7) of the stabilizing vehicles (1) are coupled directly to one another.

14. The supporting system according to claim 13, wherein, the mast support part (22) is situated directly between the coupling means (7), and the coupling means (7) are situated on both longitudinal sides (4) of the chassis (21) or directly between the coupled stabilizing vehicles (1).

15. The supporting system according to claim 13, wherein the stabilizing vehicles (1) are coupled directly to one another at a relatively low level via a tensile connection (17), and are coupled indirectly to one another at a relatively high level via a pressure-absorbing connecting piece (16).

16. The supporting system according to claim 15, wherein the tensile connection (17) is pivotable about a pivot axis (18) which extends transversely to and substantially horizontally between the stabilizing vehicles (1).

17. The supporting system according to claim 13, wherein, the mast support part (22) is situated directly between the coupling means (7), and the coupling means (7) are situated on both longitudinal sides (4) of the chassis (21) and directly between the coupled stabilizing vehicles (1).

18. The supporting system according to claim 1, wherein the stabilizing vehicles (1) are each configured as a trailer.

19. The supporting system according to claim 1, wherein each said coupling means (7) of the one stabilizing vehicle (1) can be coupled to the coupling means (7) of the other stabilizing vehicle (1).

20. The supporting system according to claim 19, wherein each said chassis (8) has an attachment means (13) at one end for coupling the chassis (8) to a tractor unit or to a set of wheels.

21. An amusement device comprising the supporting system according to claim 1, and further comprising a mast (3) erected on the mast base (2, 16) and an accommodation means for at least one person, wherein the accommodation means is suspended from the mast.

22. A supporting system for a mast (3), comprising:

plural stabilizing vehicles (1), each stabilizing vehicle comprising a chassis (8), sets of wheels (12) for moving the stabilizing vehicle, coupling means (7) near one end (6) of the chassis (8), and at least one stabilizing arm (9) displaceable between an inoperative position in which the stabilizing arm (9) is swung in and a swung-out position in which the stabilizing arm (9) extends outwards with respect to the chassis (8), wherein the stabilizing arm has a free end, and a support (10, 15) at the free end for stabilizing the stabilizing vehicle (1) on the ground (19) in the swung-out position of the stabilizing arm; and a mast base (2, 16), wherein the base (2, 16) cooperates with the stabilizing vehicles (1) and wherein, in a coupled position of said stabilizing vehicles (1), the chassis (8) of the one stabilizing vehicle (1) is in line with the chassis (8) of another stabilizing vehicle, wherein the stabilizing vehicles (1) are configured as a trailer, and wherein the stabilizing vehicles (1) each have a rear end (6) and a bearing end (13), and the stabilizing vehicles (1) are coupled to one another by the rear ends (6) and with the bearing ends (13) turned away from each other.

* * * * *